US006456176B1

(12) United States Patent
Fujihira et al.

(10) Patent No.: US 6,456,176 B1
(45) Date of Patent: Sep. 24, 2002

(54) CIRCUIT BREAKER

(75) Inventors: Takumi Fujihira, Tokyo; Naoshi Uchida, Saitama; Koji Asakawa, Saitama; Tatsunori Takahashi, Saitama; Katsunori Kuboyama, Saitama, all of (JP)

(73) Assignee: Fuji Electric Co., Ltd., Kanagawa (JP)

( * ) Notice: Subject to any disclaimer, the term of this patent is extended or adjusted under 35 U.S.C. 154(b) by 0 days.

(21) Appl. No.: 09/898,595

(22) Filed: Jul. 3, 2001

(30) Foreign Application Priority Data

Jul. 7, 2000 (JP) ..... 2000-206796

(51) Int. Cl.[7] ..... H01H 75/00; H01H 77/00; H01H 83/00

(52) U.S. Cl. ..... 335/6; 335/15; 335/16

(58) Field of Search ..... 335/6, 8, 15, 16, 335/201, 202

(56) References Cited

U.S. PATENT DOCUMENTS 5,184,717 A * 2/1993 Chou et al. ..... 200/327
5,418,343 A * 5/1995 Faber et al. ..... 200/400
5,635,886 A * 6/1997 Pichard ..... 335/132

FOREIGN PATENT DOCUMENTS

JP 6-068771 3/1994

* cited by examiner

*Primary Examiner*—Ramon M. Barrera
(74) *Attorney, Agent, or Firm*—Pearne & Gordon LLP

(57) ABSTRACT

In a circuit breaker, bag-like insulating covers 15 are formed integrally with each holder support 14. The holder support 14 is combined with a movable contact holder 13 for holding a movable contact 4, so as to press and retain the movable contact 4 by a contact spring 5. A pair of leg portions of a magnetic drive yoke 6 are inserted into each of the insulating covers 15. Thus, the magnetic drive yokes 6 are covered with the insulating covers 15 so that there is no risk of an interphase short-circuit. In addition, the magnetic drive yokes 6 are unitized with a movable contact mechanism so that the work of assembling the circuit breaker becomes easy.

2 Claims, 6 Drawing Sheets

CIRCUIT BREAKER

BACKGROUND OF THE INVENTION

1. Field of the Invention

The present invention relates to a circuit breaker for use in wiring protection or the like, and particularly relates to a bridging two-contact type circuit breaker in which the opening speed of a movable contact in high-current breaking is increased to enhance the current-limiting performance.

2. Description of the Related Art

FIGS. 9 and 10 show a conventional example of a circuit breaker of this type. FIG. 9 is a longitudinal sectional view, and FIG. 10 is a sectional view taken on line X—X in FIG. 9. In FIGS. 9 and 10, a pair of front and rear fixed contact 2 and 3 disposed so as to be opposite to each other, and a movable contact 4 for bridging the fixed contacts 2 and 3 are provided for every pole in a molded case 1. The movable contact 4 is pressed onto the fixed contacts 2 and 3 by a contact spring 5 inserted between the movable contact 4 and the molded case 1 to thereby close a conducting path. The fixed contacts 2 and 3 and the movable contact 4 have fixed contact points and movable contact points in their contact portions respectively. A pair of front and rear magnetic drive yokes 6 each of which is made of a U-shaped magnetic substance are disposed such that the opposite end portions of the movable contact 4 are held between the left and right leg portions of the magnetic drive yokes 6 respectively. In FIG. 10, a pair of left and right partition walls la are formed integrally with the molded case 1 to cover the conducting path for every pole. The bottom portion of the molded case 1 is opened, and this opening is closed by a bottom cover 7. The bottom cover 7 supports the magnetic drive yokes 6. In the bottom cover 7, a pair of left and right partition walls 7*a* are formed for every pole and integrally with the bottom cover 7 to thereby interphase-insulate the magnetic drive yokes 6. Arc-suppressing devices 8 (FIG. 9) are disposed in front and in the rear of the movable contacts 4 respectively.

When an overcurrent flows in the closed state in FIG. 9, a switching mechanism 10 receives a tripping signal from an overcurrent detector 9 and pushes the movable contacts 4 through a push rod 11 so as to detach the movable contacts 4 from the fixed contacts 2 and 3 against the contact springs 5. At that time, an arc is generated between the fixed and movable contact points. However, a magnetic field generated around the conducting path is enhanced by the magnetic drive yokes 6 and interlinked with the arc. Thus, the arc is driven toward the arc-suppressing device 8 by Lorentz force so as to be suppressed. At this time, the vicinities of the fixed and movable contact points are filled with high-pressure conductive gas generated by the arc. Thus, the magnetic drive yokes 6 for every pole are brought into a charged state. When the illustrated circuit breaker is assembled, the fixed contacts 2 and 3, the movable contacts 4, the switching mechanism 10, and so on, are first installed in the molded case 1. Then, the magnetic drive yokes 6 in which an insulating sheet 12 is fitted in advance are inserted from below the molded case 1. Lastly, the bottom cover 7 is fixed to the molded case 1.

In the above-mentioned conventional configuration, the magnetic drive yokes 6 brought into the charged state at the time of breaking are insulated with the partition walls 7*a* between different phases. However, there is a problem that the vicinities of the contact points are filled with conductive gas with high pressure so that the insulation of the magnetic drive yokes 6 between different poles lacks reliability. Particularly, if the bottom cover 7 is imperfectly fixed to the molded case 1, the partition walls 7*a* are displaced downward. Thus, there is a danger that the magnetic drive yokes 6 are interphase short-circuited so as to make breaking impossible. In addition, in the above-mentioned conventional configuration, all the magnetic drive yokes 6 in the respective poles are positioned by the bottom cover 7. Therefore, there is a problem that the assembling step is so troublesome that the number of man-hours increases.

SUMMARY OF THE INVENTION

It is therefore an object of the present invention to ensure the interphase insulation of the magnetic drive yokes at the time of breaking, and to make assembling easy.

To achieve the above object, according to the present invention, there is provided a circuit breaker in which there is provided for every pole and in a molded case: a pair of front and rear fixed contacts disposed to be opposite to each other;

a movable contact for bridging the fixed contactors; a pair of front and rear magnetic drive yokes made of U-shaped magnetic bodies and disposed to hold opposite end portions of the movable contact between left and right leg portions of the magnetic drive yokes respectively; a gate-like movable contact holder having a pair of left and right leg portions for holding the movable contact movably in an open/close direction, the movable contact holder being guided movably in the open/close direction of the movable contact by the molded case; a U-shaped holder support combined with the movable contact holder slidably in the open/close direction of the movable contact; a pair of front and rear insulating covers formed integrally with the holder support so that each of the insulating covers covers a pair of leg portions of each of the magnetic drive yokes; and a contact spring inserted between the movable contact and the holder support; wherein the movable contact is pressed onto the fixed contacts by the contact spring so as to close a conducting path for each pole, while the movable contact is pressed against the contact spring by a switching mechanism so as to be detached from the fixed contacts when the conducting path is opened; and wherein a lock protrusion formed on one of the movable contact holder and the holder support is engaged with a lock surface formed on the other of the movable contact holder and the holder support so as to bear spring force of the contact spring.

In the invention, since the magnetic drive yokes are covered with the insulating covers, there is no fear that any interphase short-circuit occurs even if the vicinities of the contact points are filled with conductive gas. In addition, the magnetic drive yokes are inserted into the holder supports so as to be supported thereby, while the holder supports are locked in the movable contact holders by spring force of the contact springs so as to be retained by the movable contact holders. Thus, the movable contact mechanism is unitized so that assembling becomes easy. It is preferable that a commutating plate for commutating the movable-contact-side foot of an arc generated between the fixed contact and the movable contact at the time of current breaking is formed integrally with the magnetic drive yokes.

DETAILED DESCRIPTION OF THE PREFERRED EMBODIMENTS

Figure 1:
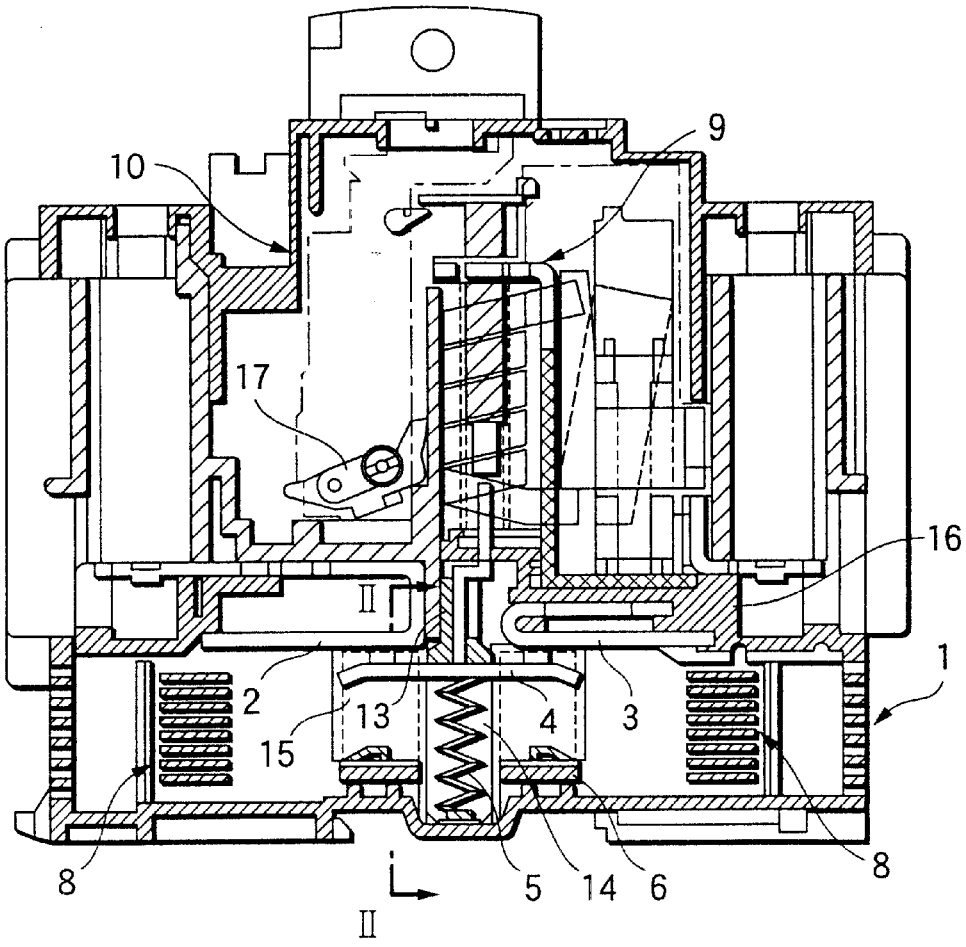
FIG. 1 is a longitudinal sectional view showing a circuit breaker according to an embodiment of the present invention.
Figure 2:
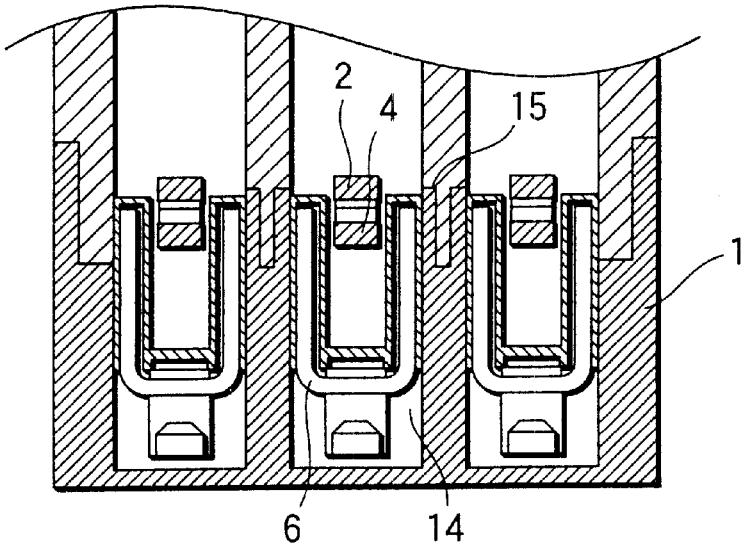
FIG. 2 is a sectional view taken on line II—II in FIG. 1.

Embodiments of the present invention will be described below with reference to FIGS. 1 to 8. Incidentally, parts corresponding to in the conventional example are referenced correspondingly. First, FIG. 1 is a longitudinal sectional view of a circuit breaker, and FIG. 2 is a sectional view taken on line II—II in FIG. 1. In FIGS. 1 and 2, this embodiment is different from the conventional example in the following points. That is, a movable contact 4 is retained in a movable contact holder 13 while the movable contact holder 13 is combined with a holder support 14 and a contact spring 5 is inserted between the movable contact 4 and the holder support 14. In addition, a pair of front and rear insulating covers 15 are formed integrally with the holder support 14, and a pair of leg portions of a magnetic drive yoke 6 are covered with each of the insulating covers 15. The bottom portion of a molded case 1 is closed. The contact spring 5 is compressed between the movable contact 4 and the bottom plate of the molded case 1 through the holder support 14 so that the movable contact 4 is pressed onto fixed contacts 2 and 3.

Figure 3:
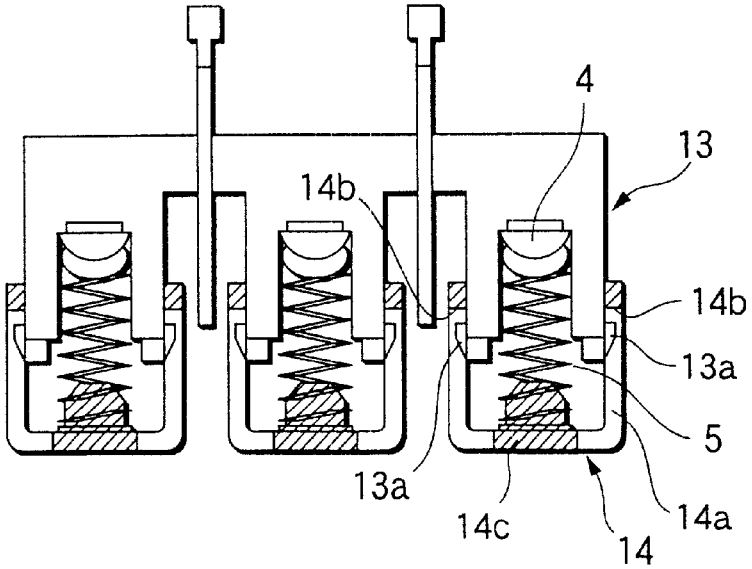
FIG. 3 is a front view showing a movable contact mechanism in FIG. 1.

FIG. 3 is a front view showing a movable contact mechanism in which the movable contact 4 is retained by the movable contact holder 13 and the holder support 14. In FIG. 3, the movable contact holder 13 is shaped into a gate having a pair of left and right leg portions, and formed integrally with movable contact holders 13 for other two of the three poles by resin molding. The movable contact 4 is retained between the left and right leg portions so as to be movable in the open/close direction (in the up/down direction in FIG. 3). In addition, the movable contact holder 13 is retained by the molded case 1 so as to be guided movably in the open/close direction of the movable contact 4. The holder support 14 is slidably combined with the movable contact holder 13. The holder support 14 is a resin molded part formed into a U-shape having a pair of left and right leg portions. A slit 14*a* is provided in each of the leg portions along the open/close direction.

The holder support 14 is combined with the movable contact holder 13 so that the pair of leg portions of the holder support 14 loosely overhang the outsides of the pair of leg portions of the movable contact holder 13 respectively. Lock protrusions 13*a* on the side surfaces of the movable contact holder 13 are slidably fitted into the slits 14*a* respectively. Thus, the lock protrusions 13*a* engage with lock surfaces 14*b* at the upper ends of the slits 14*a* respectively. A spring bearing protrusion portion 14*c* is formed on the bottom surface of the holder support 14. The lower end portion of the contact spring 5 inserted between the holder support 14 and the movable contact 4 is fitted to the spring bearing protrusion portion 14*c* while the upper end portion of the contact spring 5 pushes the movable contact 4 up. In the state where the movable contact mechanism has been assembled in a unit, the lock surfaces 14*b* engage with the lock protrusions 13*a* respectively so that the holder support 14 bearing the spring force of the contact spring 5 is retained by the movable contact holder 13.

Figure 4A:
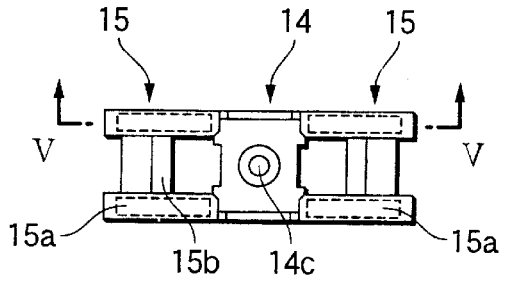
FIG. 4A is a plan view showing a holder support.
Figure 4B:
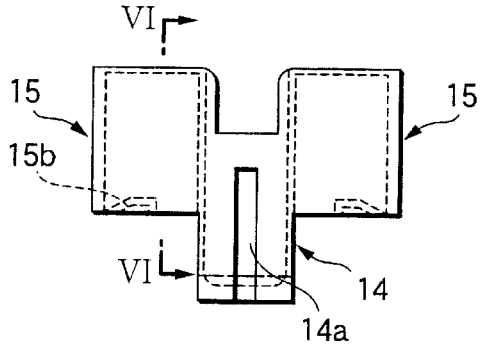
FIG. 4B is a side view thereof.
Figure 5:
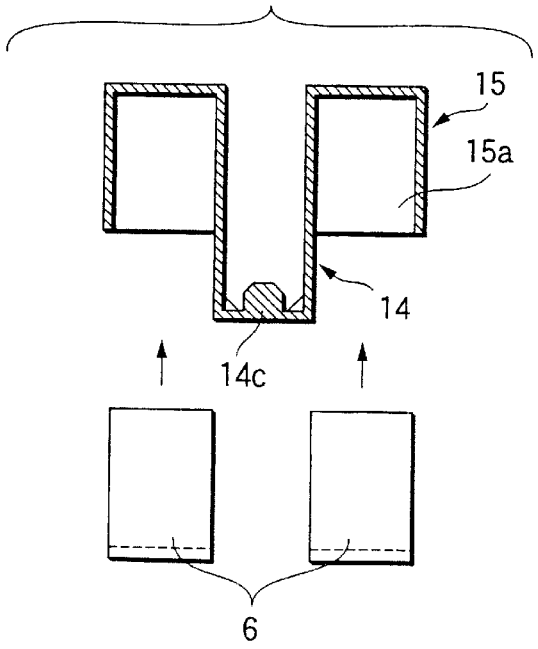
FIG. 5 is a sectional view taken on line V—V in FIG. 4A.
Figure 6:
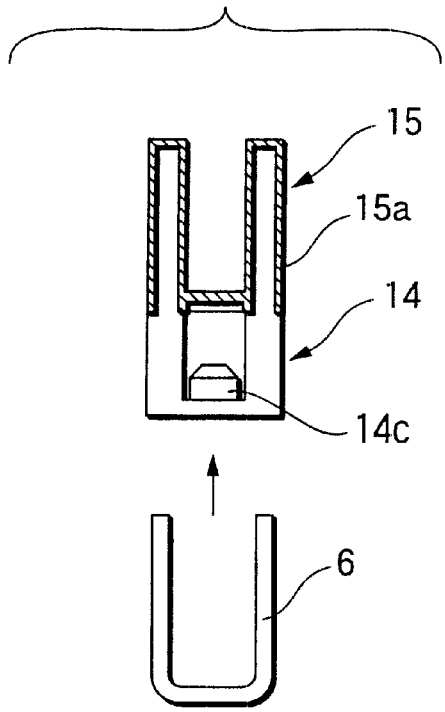
FIG. 6 is a sectional view taken on line VI—VI in FIG. 4B.

FIGS. 4A and 4B show the whole configuration of the holder support 14. FIG. 4A is a plan view thereof, and FIG. 4B is a side view thereof. In addition, FIG. 5 is a sectional view taken on V—V in FIG. 4A, and FIG. 6 is a sectional view taken on line VI—VI in FIG. 4B. In these drawings, in front and in the rear of the holder support 14 (right and left in FIGS. 4A and 4B), a pair of front and rear insulating covers 15 covering the magnetic drive yokes 6 are formed integrally with the holder support 14. Each of the insulating covers 15 is constituted by a pair of left and right bag-like portions 15*a* overhanging the leg portions of the magnetic drive yoke 6. The lower surfaces of the bag-like portions 15*a* are opened. In addition, a stopper 15*b* for bearing the movable contact 4 detached by electromagnetic repulsive force which will be described later is provided in each of the insulating covers 15, so as to be laid between the left and right bag-like portions 15*a*.

When the circuit breaker is assembled in FIG. 1, the movable contact mechanism is partially assembled in the state of FIG. 3. Further, each unit in which the magnetic drive yokes 6 have been inserted between the insulating covers 15 in the arrow direction in FIGS. 5 and 6 is incorporated from above the molded case 1. At that time, the holder supports 14 and the magnetic drive yokes 6 are supported in contact with recess portions and ribs of the bottom plate of the molded case 1 respectively. After that, a fixed contact mechanism in which the fixed contacts 2 and 3, an overcurrent detector 9, a switching mechanism 10, and so on, have been assembled on a base 16 is fixedly incorporated in the molded case 1. At that time, the movable contacts 4 are pushed down against the contact springs 5 by a proper wiping quantity by the fixed contacts 2 and 3 so that contact pressure is applied between the fixed and movable contact points by the spring reaction force.

Figure 7:
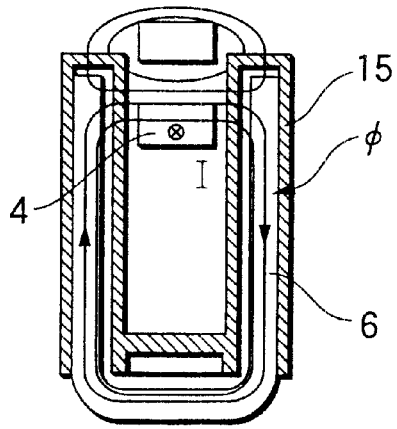
FIG. 7 is a cross sectional view for explaining magnetic flux passing through magnetic drive yokes in FIG. 1.

FIG. 7 shows magnetic flux $\Phi$ of a current I flowing in the movable contact 4. If a large current such as a short-circuit current flows in the closed state in FIG. 1, the magnetic flux $\Phi$ of the current I flowing in the movable contact 4 shown in FIG. 7 is interlinked with the current I flowing in the movable contact 4 by the magnetic drive yoke 6. Thus, the movable contact 4 receives intensive electromagnetic repulsive force (Lorentz force) so as to be driven to be opened. At the same time, the overcurrent detector 9 detects an overcurrent and outputs a tripping signal. In response to the tripping signal, the switching mechanism 10 rotates a switching lever 17 clockwise in FIG. 1 so as to push down the movable contact 4 through the movable contact holder 13. Consequently, an arc is generated between the fixed and movable contact points. However, this arc is interlinked with the magnetic flux $\Phi$ enhanced by the magnetic drive yoke 6 so as to be driven and moved to an arc-suppressing device 8. Thus, the arc led into the arc-suppressing device 8 is divided and cooled to be suppressed. Then, the short-circuit breaking operation is completed.

In the above-mentioned breaking operation process, the vicinity of the contact point is filled with high-pressure conductive gas generated by the arc. However, as shown in FIG. 1, the leg portions of the magnetic drive yokes 6 are perfectly covered with the insulating covers 15 respectively. Accordingly, there is no fear that an interphase short-circuit between the magnetic drive yokes 6 is caused. In addition, the magnetic drive yokes 6 inserted to the insulating covers 15 integrated with the holder supports 14 are unitized together with the movable contact mechanism. Since the magnetic drive yokes 6 are incorporated as a unit together with the movable contact mechanism in the molded case 1, the work of assembling is easy.

Figure 8:
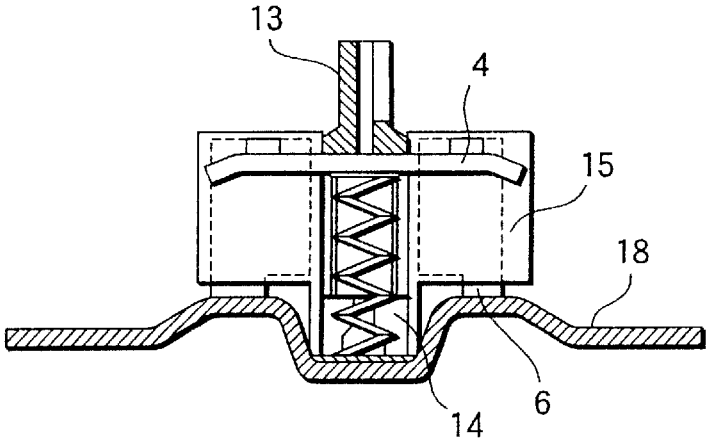
FIG. 8 is a side view showing a movable contact mechanism according to another embodiment of the present invention.
Figure 9:
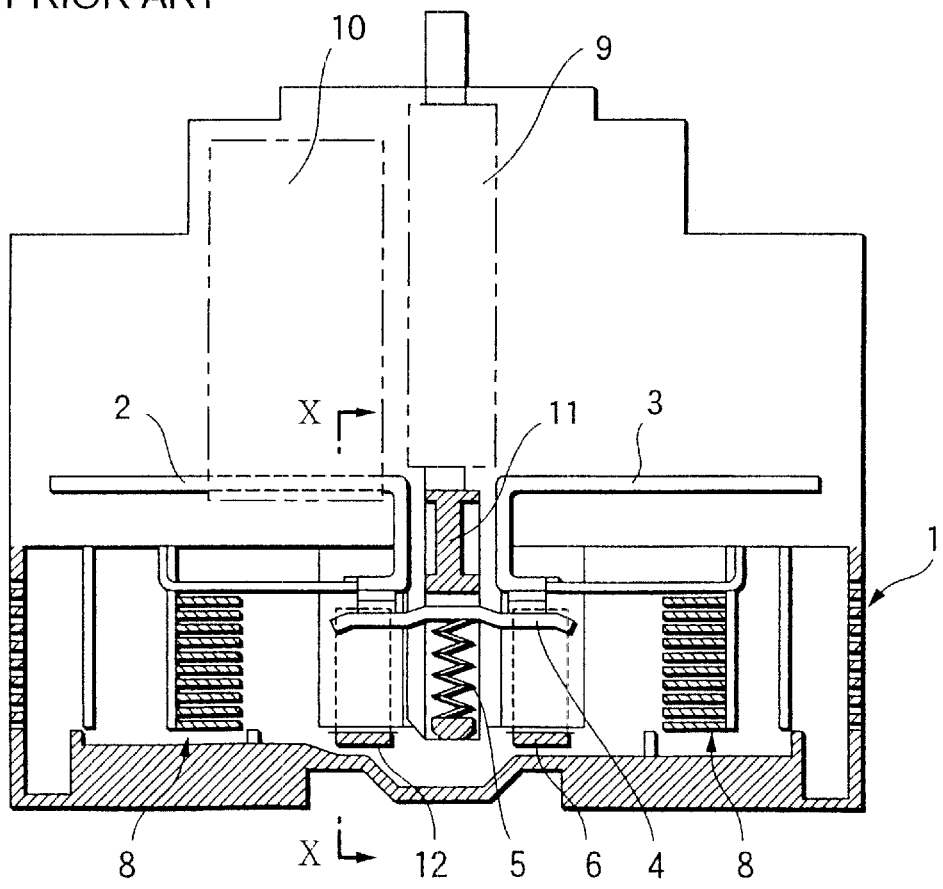
FIG.9 PRIOR ART
FIG. 9 is a longitudinal sectional view showing a conventional circuit breaker.
Figure 10:
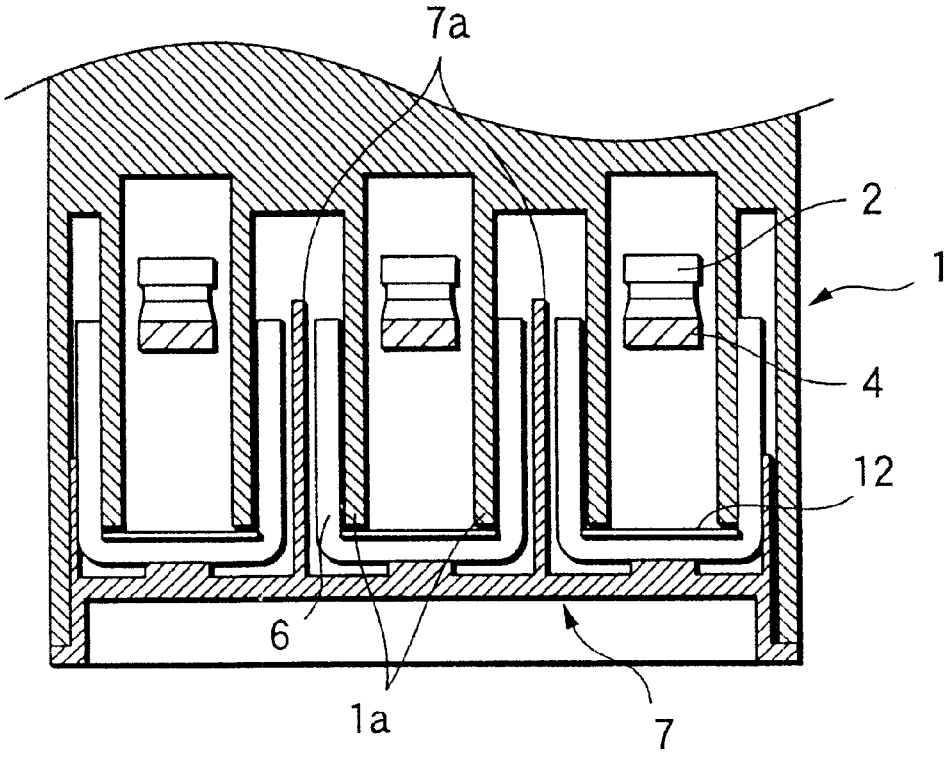
FIG.10 PRIOR ART
FIG. 10 is a sectional view taken on line X—X in FIG. 9.

FIG. 8 shows another embodiment in which a commutating plate 18 is formed integrally with the magnetic drive yokes 6. The commutating plate 18 has a length ranging between arc-suppressing devices 8 and 8 in front of and in the rear of the movable contacts 4. The commutating plate 18 is bent at both sides and a pair of front and rear magnetic drive yokes 6 are formed integrally with the commutating plate 18 at the both sides. The commutating plate 18 is to commutate the movable contact 4 side foot of the aforementioned arc generated at the time of current breaking. As a result of this commutation, a current flows bypassing the movable contact 4 so as to suppress the wastage of the movable contact point. Thus, by forming the magnetic drive yokes 6 integrally with the commutating plate 18, the front and rear magnetic drive yokes 6 for each pole are integrated with each other through the commutating plate 18 so that assembling and parts management become easy.

As has been described, according to the present invention, an interphase short-circuit between magnetic drive yokes caused by conductive gas generated at the time of current breaking is prevented surely. In addition, a movable contact mechanism including the magnetic drive yokes is made into a unit so that the number of man-hours can be reduced.

What is claimed is:

1. A circuit breaker comprising:

a pair of front and rear fixed contact disposed to be opposite to each other;

a movable contact for bridging said fixed contact;

a pair of front and rear magnetic drive yokes made of U-shaped magnetic bodies and disposed to hold opposite end portions of said movable contact between left and right leg portions of said magnetic drive yokes respectively;

a gate-like movable contact holder having a pair of left and right leg portions for holding said movable contact movably in an open/close direction, said movable contact holder being guided movably in said open/close direction of said movable contact by said molded case;

a U-shaped holder support combined with said movable contact holder slidably in said open/close direction of said movable contact;

a pair of front and rear insulating covers formed integrally with said holder support so that each of said insulating covers covers the pair of leg portions of each of said magnetic drive yokes; and a contact spring inserted between said movable contact and said holder support;

wherein said movable contact is pressed onto said fixed contact by said contact spring so as to close a conducting path for each pole, while said movable contact is pressed against said contact spring by a switching mechanism so as to be detached from said fixed contact when said conducting path is opened; and wherein a lock protrusion formed on one of said movable contact holder and said holder support is engaged with a lock surface formed on the other of said movable contact holder and said holder support so as to bear spring force of said contact spring.

2. The circuit breaker according to claim 1, wherein a commutating plate for commutating said-movable-contact-side foot of an arc generated between said fixed contact and said movable contact at the time of current breaking is formed integrally with said magnetic drive yokes.

* * * * *

UNITED STATES PATENT AND TRADEMARK OFFICE

CERTIFICATE OF CORRECTION

PATENT NO. : 6,456,176 B1
DATED : September 24, 2002
INVENTOR(S) : Takumi Fujihira et al.

It is certified that error appears in the above-identified patent and that said Letters Patent is hereby corrected as shown below:

Column 1,
Line 15, please delete “contact”, and insert therefor -- contacts --.

Column 2,
Line 19, please delete “contactors”, and insert therefor -- contacts --.

Signed and Sealed this

Eighteenth Day of February, 2003

JAMES E. ROGAN
*Director of the United States Patent and Trademark Office*